United States Patent [19]

Woodcock et al.

[11] Patent Number: 4,522,107

[45] Date of Patent: Jun. 11, 1985

[54] SHOCK-ABSORBING RECOIL MECHANISM

[75] Inventors: Sidney H. Woodcock; Michel E. Maes, both of Bellevue; Ronald W. Steimel, Mountlake Terrace, all of Wash.

[73] Assignee: Detonics Pistol Accessories Ltd., Bellevue, Wash.

[21] Appl. No.: 299,000

[22] Filed: Sep. 3, 1981

[51] Int. Cl.[3] ..... F41D 11/12

[52] U.S. Cl. ..... 89/196; 89/198

[58] Field of Search ..... 89/163, 195, 196, 198

[56] References Cited

U.S. PATENT DOCUMENTS 3,122,061 2/1964 Atchisson ..... 89/196

3,901,125 8/1975 Raville ..... 89/163

*Primary Examiner*—Stephen C. Bentley

*Attorney, Agent, or Firm*—Seed and Berry

[57] ABSTRACT

A shock-absorbing recoil mechanism for a semiautomatic firearm includes a pair of rigid plates positioned on opposite sides of a resilient sheet of energy-dissipating material. The plates and sheet are positioned in the U-shaped cavity of the firearm frame against reduced diameter shoulders formed toward the rear end thereof. The slide, when moving to its recoil position, thus contacts the forward plate instead of the shoulder in order to reduce the peak value of the recoil force applied to the frame by the slide. The shock-absorbing assembly may be combined with the recoil spring by utilizing a spring guide rod which projects through the plates and resilient material. The recoil spring surrounds the guide rod and projects forwardly against a cap mounted in the forward end of the slide.

15 Claims, 5 Drawing Figures

FIG. 1
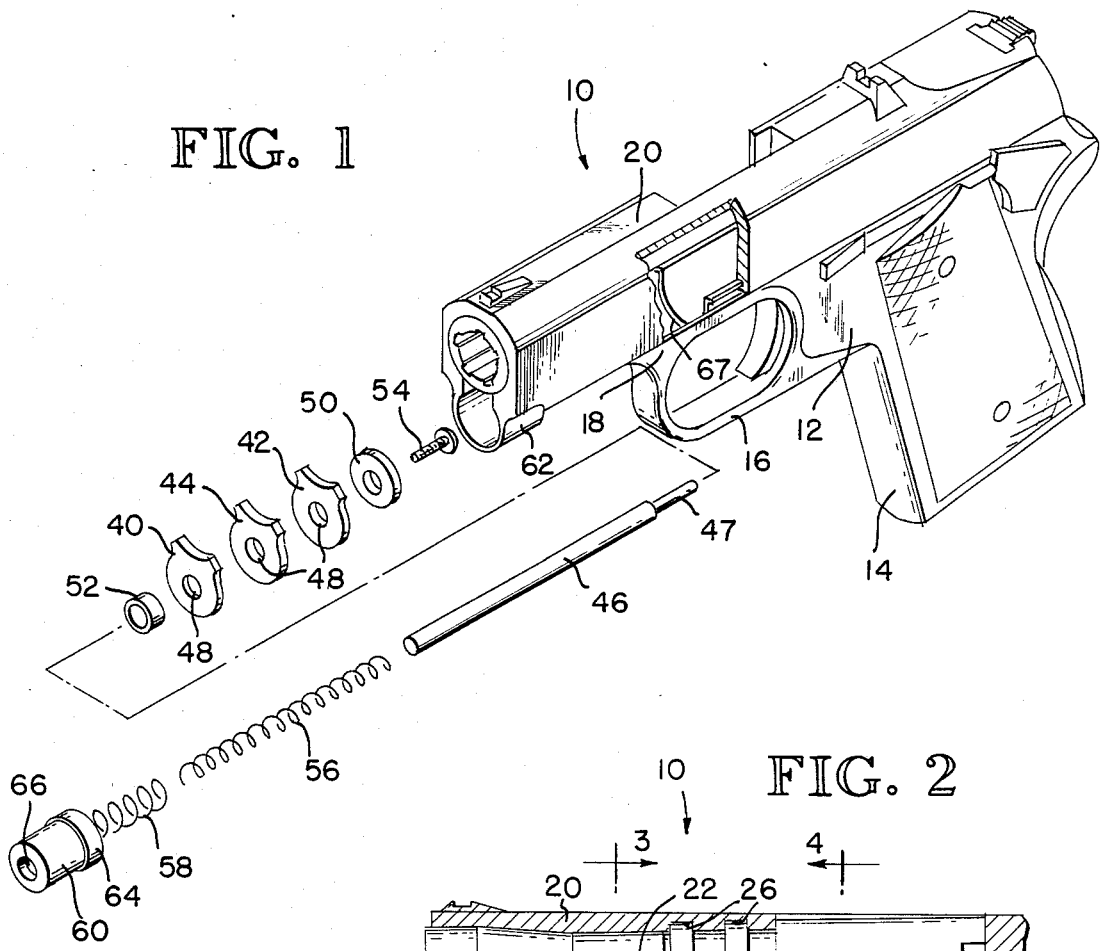
FIG. 2
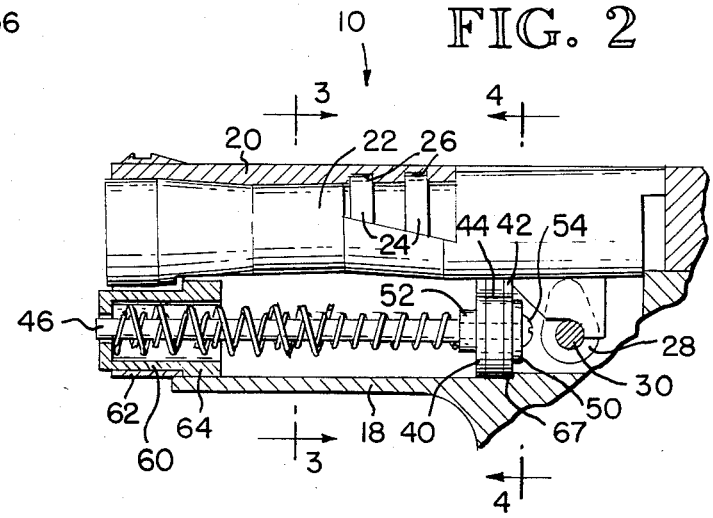
FIG. 4
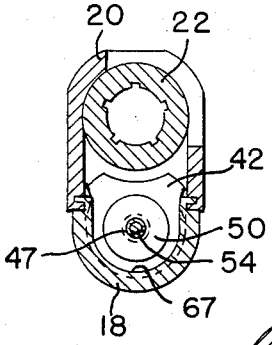
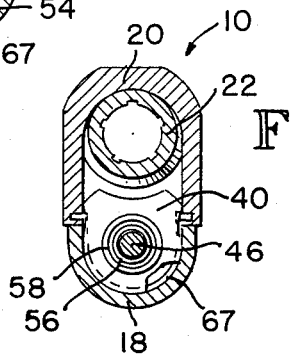
FIG. 3
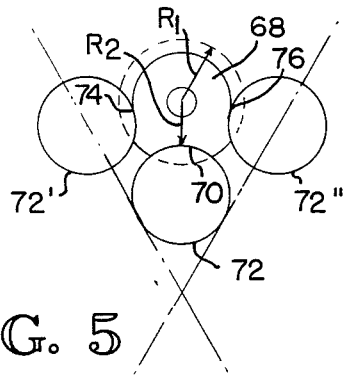
FIG. 5

SHOCK-ABSORBING RECOIL MECHANISM

DESCRIPTION

1. Technical Field

This invention relates to semiautomatic firearms, and more particularly, to a mechanism for absorbing recoil forces by cushioning the impact of the rearward movement of the firearm's slide.

2. Background Art

Semiautomatic firearms utilize a generally hollow slide surrounding a generally cylindrical barrel. The barrel has a center bore through which the bullet travels as it exits the firearm. The barrel is normally able to move axially a short distance, but it is then restrained against rearward movement. The slide, on the other hand, is normally able to move rearwardly a considerable distance. The barrel is connected to the slide by locking lugs when the slide is in its firing or "battery" position. Consequently, the rearward recoil force of the barrel is transmitted to the slide, thereby causing the slide to move rearwardly. The slide and barrel thus move rearwardly together a short distance, but the barrel is then restrained from further movement, leaving the slide to continue its rearward movement. The rearward movement of the slide is absorbed to some extent by one or more recoil springs biasing the slide forwardly. However, a portion of the slide, generally either the cap surrounding the recoil spring or a stirrup in which the cap is mounted, slams against the frame of the firearm at the end of the recoil stroke. The resulting shock decreases the accuracy of the firearm and it also has a tendency to fatigue parts of the firearm and to otherwise increase its rate of wear.

Attempts have been made to absorb the recoil forces of semiautomatic firearms, usually by placing a resilient material at the point of contact between the cap or stirrup and the frame. Such techniques have been generally unsuccessful for two reason. First, the resilient material previously selected has not been able to withstand the high temperatures and pressures encountered in use over a substantial period of time. Second, the forces are applied to the resilient material by the slide and frame over a relatively small area, thereby seriously limiting the effectiveness of the resilient material and quickly breaking down the resilient material. As a result, conventional shock-absorbing structures have not generally met with commercial success.

DISCLOSURE OF THE INVENTION

The principal object of the invention is to provide a mechanism for absorbing recoil forces in a semiautomatic firearm.

Another object of the invention is to provide a recoil mechanism which may be used with a wide variety of semiautomatic firearms.

It is still another object of the invention to provide a recoil mechanism for semiautomatic firearms which is relatively inexpensive and easy to manufacture.

It is a further object of the invention to provide a recoil mechanism which may be easily retrofitted on a variety of existing semiautomatic firearms without the need for a skilled gunsmith.

These and other objects of the invention are provided by a shock-absorbing assembly for a semiautomatic firearm of the type having an elongated frame, an elongated barrel mounted on the frame, and an elongated slide surrounding the barrel and slidably mounted on the frame. The frame has a U-shaped cavity forming an upwardly facing opening and a shoulder formed along the rear sidewalls of the cavity. A recoil spring surrounding a guide rod extends forwardly from the frame to a portion of the slide to resiliently bias the slide in its forward battery position. A pair of plates positioned on opposite sides of a sheet of resilient material are positioned in the U-shaped cavity, with one of the plates abutting the shoulder. Consequently, the slide contacts the plate instead of the shoulder when moving to its battery position, thereby allowing the resilient material to absorb the recoil shock. The recoil mechanism may interface with the shock-absorbing assembly by rigidly mounting the guide rod to the assembly, with the end of the recoil spring abutting the forward plate. The resilient material preferably has a transverse dimension which is slightly larger than the transverse dimension of the plates. The lower inside edges of the slide thus contact the resilient material instead of the plates so that the resilient material spaces the plates from the slide. A locator washer may be mounted on the rear surface of the rear plate. The diameter of the washer is slightly smaller than the inside transverse dimension of the shoulder in order to position the plates and resilient sheet within the U-shaped cavity.

BRIEF DESCRIPTION OF THE DRAWINGS

FIG. 1 is an exploded isometric view of the shock-absorbing recoil mechanism as it is positioned in a conventional semiautomatic firearm.

FIG. 2 is a cross-sectional view of the shock-absorbing recoil mechanism mounted in the firearm of FIG. 1.

FIG. 3 is a cross-sectional view taken along the line 3—3 of FIG. 2.

FIG. 4 is a cross-sectional view taken along the line 4—4 of FIG. 2.

FIG. 5 is a plan view showing the shape of the plate and resilient sheet used in the shock-absorbing recoil assembly.

BEST MODE FOR CARRYING OUT THE INVENTION

A conventional semiautomatic firearm 10, as illustrated in FIGS. 1–3, includes a frame 12 forming a handle portion 14, a trigger guard 16, and an elongated slide support 18. A slide 20 is mounted on the slide support 18 through an interlocking structure which allows the slide 20 to move longitudinally with respect to the frame 18 but which otherwise secures the slide 20 and frame 18 to each other. The slide 20 surrounds an elongated barrel 22. The barrel has formed therein a pair of locking lugs 24 which fit into respective grooves 26 formed in the slide 20 when the slide 20 is in its forward firing or "battery" position. A link 28 is pivotally secured to the barrel 22. The link 28 has a transverse bore through which a pin 30 extends to secure the link 28 to the frame.

When the firearm is fired, the recoil force causes the barrel 22 to move rearwardly. Since the barrel 22 is connected to the slide 20 through the locking lugs 26 in grooves 24, the slide 20 also moves rearwardly. However, after the barrel 22 and slide 20 have moved a short distance, the pivotal movement of the link 28 pulls the rear end of the barrel 22 downwardly, thereby disengaging the locking lugs 24 from the grooves 26. Further, the link 28 prevents continued rearward movement of the barrel 22. However, since the slide 20 is not similarly restrained, it continues to move rearwardly. As explained in greater detail hereinafter, this rearward movement terminates when the slide 20 is in its recoil position, at which time a portion of the slide 20 abruptly contacts a portion of the frame. This abrupt contact is undesirable for a number of reasons, as explained above.

The shock-absorbing recoil assembly is formed by a pair of specially configured plates 40,42 positioned on opposite sides of a similarly shaped sheet of resilient material 44. The resilient material 44 preferably has an energy-dissipating characteristic in addition to being resilient. In other words, the material forming the sheet 44 is not purely resilient, but it also absorbs energy in the form of heat as it is compressed and released.

A recoil spring guide rod 46 has a reduced diameter portion 47 which extends through respective bores 48 formed in the plate 40,42 and resilient sheet 44. The reduced diameter portion of the rod 46 also extends through a locator washer 50 and a collar 52, and is secured in position by a screw 54 threaded into the reduced diameter end of the rod 46. An inside recoil spring 56 surrounds the guide rod 46. An outer recoil spring 58 surrounds the inner recoil spring 56, and its ends abut the forward plate 40 and the rear surface of a cap 60. The radial position of the spring 58 is fixed by the collar 52 since the diameter of the collar 52 is slightly smaller than the inside diameter of the spring 58. In practice, the collar 52 may be eliminated since the inner spring 56 has an outside diameter that is slightly smaller than the inside diameter of the outer spring 58, and the springs 56,58 are wound in opposite directions. The inner spring 56 thus acts as a guide for the outer spring 58.

It will be understood that the plates 40,42, resilient sheet 44 and locator washer 50 may be mounted on the rod 46 with other structures. For example, the locator washer 50 and screw 54 may be combined as a large headed screw threaded into the end of the rod 46. Further, the reduced diameter portion 47 of the rod 46 may be eliminated, with the plates 40,42 and sheet 44 either fitting over the end of the rod 46 or mounted on the end of the rod 46 by a large headed screw.

The cap 60 is inserted in a stirrup 62 formed at the front of the slide 20. A relatively wide rim 64 integrally formed with the cap abuts the rear edge of the stirrup 62 to prevent forward movement of the cap 60. The cap 60 is, of course, held in position by the forwardly directed forces of the recoil springs 56,58. The cap 60 contains a bore 66 through which the end of the guide rod 46 projects. As a result, the slide 20 is able to move rearwardly while the guide rods 46 remain stationary.

In conventional semiautomatic firearms, the guide rod 46 extends rearwardly beyond the position illustrated in FIG. 2 and terminates in a specially constructed fitting. The fitting contacts the pin 30 on one side and the rear end of the recoil spring on the other. The conventional recoil mechanism thus allows the rear edge of the cap 64 to abruptly contact a shoulder 67 (FIG. 2) formed in the frame 12 when the slide 20 is in its recoil position. As mentioned above, this is highly undesirable. In some models of firearms, the stirrup 62 is wider than the length of the cap 60 so that the cap 60 is recessed within the stirrup 62. In these models, it is the stirrup 62 instead of the cap 60 that contacts the shoulder 67. Nevertheless, the results are the same, namely, reduced accuracy and increased wear.

The inventive recoil mechanism, on the other hand, places a resilient sheet 44 between the cap 64 and shoulder to absorb some of the recoil shock and spread it over a longer duration so that the peak force between the slide 20 and frame 18 is relatively low. Further, the use of a forward plate 40 instead of merely allowing the cap 64 to directly contact the resilient sheet 44 spreads the forces over a relatively large area to maximize the shock-absorbing characteristics.

The shoulder 67 is normally manufactured so that it occupies a plane that is perpendicular to the longitudinal axis of the barrel 22. However, after substantial use, the shoulder may become distorted to a skewed position, and the rear edge of the cap 64 distorts to match the position of the shoulder 67. When the inventive recoil mechanism is installed in a used firearm or in a firarm that has not been manufactured to exact tolerances, the rod 46 would not be parallel to the longitudinal axis of the barrel 22. As a result, the rod 46 would rub against the hole in the cap 64, causing excessive wear and slowing the movement of the slide 20. In order to allow the rod 46 to align itself with the longitudinal axis of the barrel 22 when the shoulder 67 is skewed, the plates should fit over the rod 46 rather loosely, thereby allowing the rod 46 to tilt with respect to the plates 40,42.

As best illustrated in FIG. 4, the spacer washer 50 has a diameter which is slightly smaller than the inside transverse dimension of the shoulder 67. As a result, the spacer washer 50 positions the plates 40,42 and resilient sheet 44 in the frame 18.

It is also important to note that the transverse dimension of the resilient sheet is slightly larger than the transverse dimension of the plates 40,42. Consequently, the inside edges of the slide 20 contact the resilient sheet 44 and not the plates 40,42 as the slide 20 moves forwardly and rearwardly. The resilient sheet 44 is preferably of a material having a relatively low coefficient of friction. The contact between the slide 20 and sheet 44 thus does not wear away the sheet 44 nor does it restrict the free movement of the slide 20. The resilient sheet 44, by contacting the slide 20, spaces the plates 40,42 away from the slide 20.

The resilient sheet 44 may be formed of a variety of materials, but in one operational embodiment, it is formed from polypropylene.

The preferred configuration of the plates 40,42 and resilient sheet 44 is best shown in FIG. 5. The plates are formed by a blank 68 having a radius of $R_1$. A first cutout 70 corresponding to the circumference of a circle having a radius equal to the outer radius of the barrel is then formed in the blank at a distance of $R_2$ from the center of the blank 68. Lines diverging from each other at 120 degrees and tangent to the circle 72 are then formed, and identical circles 72', having their centers positioned on the diverging lines, then form respective cutouts 74,76 on opposite sides of the first cutout 70. Note that the distance of all cutouts 70,74,76 from the center of the blank 68 is equal to $R_2$. Finally, the portion of the blank 68 between cutouts 74 and 76 is reduced to a circle having a radius of $R_2$. It will be understood, however, that the plates and resilient sheet may be formed in other configurations as long as it fits within the U-shaped cavity of the frame 12.

The inventive shock-absorbing mechanism has been illustrated herein installed on a semiautomatic firearm sold by Detonics .45 Associates of Seattle, Wash. It will be understood, however, that it may be installed in other types of semiautomatic firearms if modified to reflect slight structural differences between such firearms and the firearm illustrated herein. For example, a Colt semiautomatic firearm would utilize a differently shaped cap 60. Also, the collar 52 may have an indented ring formed around the edge nearest the plate 40. The outer recoil spring 58 extends around the collar 52 and fits into the ring to prevent the spring from flying off the rod 46 when the cap 60 of the Colt firearm is released.

The shock-absorbing recoil mechanism may thus be installed on a wide variety of semiautomatic firearms, and it is relatively inexpensive to manufacture. Further, it may be installed by individuals having relatively little training, and it markedly increases the shooting accuracy and life of semiautomatic firearms.

We claim:

1. In a semiautomatic firearm having an elongated frame including a generally U-shaped cavity with an upwardly facing opening and a shoulder formed along the sidewalls toward the rear thereof, an elongated barrel mounted on said frame and at least partially restrained from movement therewith, an elongated slide mounted on said frame and surrounding said barrel, said slide being adapted to slide along said frame between a battery position and a recoil position, a recoil spring assembly resiliently biasing said slide toward its battery position, said assembly including an elongated spring guide extending between said frame and said slide, and a recoil spring extending rearwardly from a forward portion of said slide to a portion of said frame near said shoulder, and a shock-absorbing assembly comprising a sheet of resilient material positioned between a pair of plates, said sheet and plates having a shape corresponding to that of said U-shaped cavity, said sheet and plates being placed in said cavity with one of said plates abutting said shoulder, the material forming said resilient sheet having a low coefficient of friction and the transverse dimension of said resilient sheet being slightly larger than the transverse dimensions of said plates so that the lower inside edges of said slide contact said resilient sheet instead of said plates, whereby said slide engages the other of said plates when moving to its recoil position, thereby compressing said resilient sheet to absorb the recoil force of said slide against said frame, and whereby said resilient sheet spaces said plates from said slide.

2. The shock-absorbing assembly of claim 1 wherein the material forming said resilient sheet dissipates energy as it is compressed.

3. The semiautomatic firearm of claim 1 wherein the rear end of said spring guide has means for retaining said plates thereon.

4. The semiautomatic firearm of claim 1, further including a spacer washer mounted on the rear surface of the rear plate, said washer having a diameter which is slightly smaller than the inside transverse dimension of said shoulder, whereby said washer facilitates alignment of said plates and resilient sheet in a transverse position.

5. The shock-absorbing assembly of claim 1, further including a cylindrical collar mounted on the front surface of the front plate, said collar having a diameter which is less than the outside diameter of said recoil spring, whereby said collar fixes the radial position of said spring.

6. A semiautomatic firearm comprising:

an elongaged frame having a generally U-shaped cavity with an upwardly facing opening and a shoulder formed along the sidewalls toward its rear end;

an elongated barrel mounted on said frame and at least partially restrained from movement therewith;

an elongated slide mounted on said frame and surrounding said barrel, said slide being adapted to slide along said frame between a battery position and a recoil position;

a firing mechanism for initiating combustion in a round positioned within said barrel toward the rear end thereof;

a recoil spring assembly resiliently baising said slide toward its battery position;

a shock-absorbing recoil mechanism including first and second plates having a shape corresponding to that of said U-shaped cavity, a sheet of resilient material positioned between said plates, said plates and resilient sheet being placed in said cavity with said second plate abutting said shoulder, the material forming said resilient sheet having a relatively low coefficient of friction and the transverse dimension of said resilient sheet being slightly larger than the transverse dimensions of said plates so that the lower inside edges of said slide contact said resilient sheet instead of said plates, whereby said resilient sheet spaces said plates from said slide;

an elongated guide rod projecting forwardly from said first plate along said barrel; and a recoil spring surrounding said guide rod, said spring having one end abutting the forward surface of said first plate and the other end engaging a portion of said slide, whereby said spring biases said slide to its battery position and said resilient sheet absorbs the recoil force of said slide against said frame.

7. The semiautomatic firearm of claim 6 wherein the material forming said resilient sheet dissipates energy as it is compressed.

8. The semiautomatic firearm of claim 6, further including a spacer washer mounted on the rear surface of said second plate, said washer having a diameter which is slightly smaller than the inside transverse dimension of said shoulder, whereby said washer facilitates alignment of said plates and resilient sheet in a transverse position.

9. The semiautomatic firearm of claim 6, further including a cylindrical collar mounted on the front surface of said first plate, said collar having a diameter which is less than the outside diameter of said recoil spring, whereby said collar fixes the radial position of said spring.

10. In a semiautomatic firearm having an elongated frame including a generally U-shaped cavity with an upwardly facing opening and a shoulder formed along the sidewalls toward the rear thereof and extending generally transverse to said frame, an elongated barrel mounted on said frame and at least partially restrained from movement therewith, an elongated slide mounted on said frame and surrounding said barrel, said slide being adapted to slide along said frame between a battery position and a recoil position, a shock-absorbing assembly comprising: a resilient material positioned between a pair of plates, said plates having a shape corresponding to that of said U-shaped cavity, said resilient material having a low coefficient of friction and being formed as a sheet with a shape generally corresponding to that of said U-shaped cavity, with the transverse dimension of said resilient sheet being slightly larger than the transverse dimensions of said plates so that the lower inside edges of said slide contact said resilient sheet instead of said plates, said plates being placed in said cavity with a rearward one of said plates abutting the shoulder, said slide engaging a forward one of said plates when moving to its recoil position, thereby compressing said resilient material to absorb the recoil force of said slide against said frame, and a recoil spring assembly resiliently biasing said slide toward its battery position, said spring assembly including an elongated guide rod projecting forwardly from said plates along said barrel, a recoil spring surrounding said guide rod, and a forwardly positioned spring retainer engaging said slide, said recoil spring having one end engaging said forward plate and another end engaging said spring retainer, said plates being transversely mounted to said guide rod and angularly movable relative thereto for tilting with respect to said guide rod to accommodate said shoulder being other than perpendicular to said guide rod.

11. The shock-absorbing assembly of claim 10 wherein said resilient material and plates each have a hole therethrough oversized to loosely receive said guide rod.

12. The shock-abosrbing assembly of claim 11 wherein the longitudinal positioning of said plates relative to said guide rod is maintained against the rearward urgings of said recoil spring engaging said forward plate by a plate-retaining stop fixedly attached to said guide rod rearward of said second plate.

13. The shock-absorbing assembly of claim 12 wherein said plate-retaining stop is a screw threadably attachable to said guide rod and having an enlarged head for engaging the rearward side of said rearward plate.

14. The shock-absorbing assembly of claim 10 wherein said spring retainer has an aperture therethrough for slidably receiving said guide rod and limiting lateral movement thereof.

15. The shock-absorbing assembly of claim 10 wherein said resilient material dissipates energy as it is compressed.

* * * * *